US009574508B2

(12) United States Patent
Späder

(10) Patent No.: US 9,574,508 B2
(45) Date of Patent: Feb. 21, 2017

(54) METHOD FOR OPERATING AN INTERNAL COMBUSTION ENGINE

(71) Applicant: MTU Friedrichshafen GmbH, Friedrichshafen (DE)

(72) Inventor: Tim Späder, Langenargen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 7 days.

(21) Appl. No.: 14/573,088

(22) Filed: Dec. 17, 2014

(65) Prior Publication Data

US 2015/0101314 A1 Apr. 16, 2015

Related U.S. Application Data

(63) Continuation of application No. PCT/EP2013/002676, filed on Sep. 5, 2013.

(30) Foreign Application Priority Data

Sep. 17, 2012 (DE) ..... 10 2012 018 405

(51) Int. Cl.

| | |
|---|---|
| ***F01N 9/00*** | (2006.01) |
| ***F02D 41/00*** | (2006.01) |
| ***F02D 35/00*** | (2006.01) |
| *F02D 41/02* | (2006.01) |
| *F02D 41/14* | (2006.01) |

(Continued)

(52) U.S. Cl.

CPC ..... *F02D 41/0052* (2013.01); *F01N 9/00* (2013.01); *F01N 9/002* (2013.01); *F02D 35/0007* (2013.01); *F02D 41/027* (2013.01); *F02D 41/024* (2013.01); *F02D 41/029* (2013.01); *F02D 41/1445* (2013.01);

(Continued)

(58) Field of Classification Search

CPC F01N 9/007; F01N 2900/0421; F02D 41/027; F02D 41/029; F02D 41/1445

See application file for complete search history.

(56) References Cited

U.S. PATENT DOCUMENTS

| | | | |
|---|---|---|---|
| 5,386,722 | A | 2/1995 | Meyer et al. |
| 2010/0094528 | A1 | 4/2010 | Auclair et al. |

(Continued)

FOREIGN PATENT DOCUMENTS

| | | | | |
|---|---|---|---|---|
| FR | 2970040 | A1 * | 7/2012 | ..... F01N 3/023 |
| JP | 2009-31046 | A | 2/2009 | |

(Continued)

OTHER PUBLICATIONS

Machine translation of FR 2970040 A1, accessed Jul. 26, 2016.*

International Search Report dated Feb. 26, 2014 for International Application No. PCT/EP2013/002676 (12 pages).

*Primary Examiner* — Jonathan Matthias

(74) *Attorney, Agent, or Firm* — Taylor IP, P.C.

(57) ABSTRACT

The invention relates to a method and an arrangement for operating an internal combustion engine. In the method a first distribution of values for at least one variable is used, the variable describing a physical property of the internal combustion engine, and over a second time period values for this variable are recorded and classified, such that a second distribution is determined. The first distribution is then compared with the second distribution such that the behavior of the internal combustion engine can be adapted on the basis thereof.

18 Claims, 4 Drawing Sheets

(51) Int. Cl.
*F02D 41/24* (2006.01)
*F02D 41/28* (2006.01)

(52) U.S. Cl.
CPC ..... *F02D 41/1446* (2013.01); *F02D 41/2451* (2013.01); *F02D 2041/286* (2013.01); *F02D 2200/0812* (2013.01)

(56) References Cited

U.S. PATENT DOCUMENTS

| | | | | |
|---|---|---|---|---|
| 2010/0242909 | A1 | 9/2010 | Okoshi et al. | |
| 2012/0317444 | A1 * | 12/2012 | Suzuki | E02F 9/2025 714/39 |
| 2013/0302756 | A1 | 11/2013 | Takeuchi et al. | |

FOREIGN PATENT DOCUMENTS

| | | | | |
|---|---|---|---|---|
| JP | WO 2011092830 | A1 * | 8/2011 | E02F 9/2025 |
| WO | 2011/079928 | A1 | 7/2011 | |

* cited by examiner

METHOD FOR OPERATING AN INTERNAL COMBUSTION ENGINE

CROSS REFERENCE TO RELATED APPLICATIONS

This is a continuation of PCT application No. PCT/EP2013/002676, entitled "METHOD FOR OPERATING AN INTERNAL COMBUSTION ENGINE", filed Sep. 5, 2013, which is incorporated herein by reference.

BACKGROUND OF THE INVENTION

1. Field of the Invention

The invention relates to a method for operating an internal combustion engine, in particular an internal combustion engine with allocated subsequent exhaust gas treatment.

2. Description of the Related Art

In internal combustion engines which are also referred to as combustion engines, mechanical energy is generated through combustion of a fuel-air mixture in a combustion chamber, typically a cylinder. Such internal combustion chambers, whether they are powered by diesel or gasoline are used to drive devices.

Exhaust gas treatment is to be understood as all methods wherein combustion gases are cleaned mechanically, catalytically or chemically after they have left the combustion chamber.

In order to ensure safe operation of the internal combustion engine and thereby the driven device it is necessary to record and evaluate certain variables, for example physical variables of the internal combustion engine, of the exhaust gas treatment system and of additional components at regular time intervals or even continuously. Some variables are also controlled or regulated. Physical variables are generally quantitatively determinable properties of a physical object.

Variables of the internal combustion engine are understood to be for example the rotational speed of the internal combustion engine, the speed of the device and the exhaust gas temperature. These variables are however only cited as an example here.

It is thus provided for example to increase the exhaust gas temperature as a variable as a measure to regenerate the diesel particle filter. This occurs controlled, or by establishing a target value in one adjustment. If this measure occurs for example too early through the load profile locally by the user of the vehicle this can result in unnecessarily high fuel consumption.

What is needed in the art is a method of improving the operation of an internal combustion engine, where applicable, with an allocated exhaust gas treatment system.

SUMMARY OF THE INVENTION

The method of the present invention is intended for the operation of an internal combustion engine, wherein a first distribution of values for at least one variable is used and a second distribution of these values is determined in that, over a second time period values for this variable are recorded and classified. This first distribution is then compared with the second distribution. Classification is understood to mean that the values are assigned to categories, normally to value ranges. This results in a static distribution of the values.

Variables can be physical or physically measurable variables, but also model-based other variables. Physical variables, for example the rotational speed of the internal combustion engine or the exhaust gas temperature, if applicable together with other variables describes an operational condition of the internal combustion engine and/or the exhaust gas treatment system, and thereby the operated device.

The arrangement determines the first distribution by recording of values of the at least one variable over a first time period. As a rule this occurs by means of a distribution function which allocates the determined values to categories, in other words classifies them, thus determining a static distribution in this manner.

The first time period is appropriately longer than the second time period. The first time period may for example be seven days, the second time period five hours.

The first distribution in one category can alternatively be factory-predetermined. This predetermined classification can of course be adapted during operation of the device.

An additional arrangement of the method provides that, in the second distribution the at least one variable is classified dependent on at least one second variable. In this manner dependencies between variables in the device can be considered. A dependent distribution function is used for this.

It may moreover be provided that an event is triggered on the basis of the comparison. This event may for example be that, when the exhaust gas temperature is considered as variable the exhaust gas temperature is not changed or is changed to a different extent.

In one design form of the method a threshold is considered. This means that only at a certain level of deviation of the first distribution from the second distribution this is classified as a deviation, triggering an event if applicable.

It is therefore suggested to implement the method for a system including an internal combustion engine with an allocated exhaust gas treatment system.

The suggested arrangement is used in combination with the driven internal combustion engine, for example in a driven device and is designed to implement a method of the type described previously. The arrangement includes a control device which is designed for comparison of a first distribution with a second distribution.

A classifying statistical evaluation method is hereby performed to generally optimize online operating costs for systems which include an internal combustion engine and an exhaust gas treatment system.

The presented method is basically conceivable for a system with exhaust gas treatment system. In this manner the consumption, for example the diesel consumption of an engine can be reduced. The internal combustion engine can adapt to the current engine operating profile, without thereby jeopardizing the safety of the system.

Certain variables of the engine are hereby classified into categories and a distribution is established in an arrangement over two different time periods. The behavior over the two different time periods is processed further based on the model. The result can then moreover be statistically evaluated and depending on probability of a certain result, an action can be activated or delayed.

The method serves automated optimization of the operating costs for the internal combustion engine. It is advantageous that the fuel consumption can be reduced during operation of the engine. Due to the load profile, on-site with the customer, measures for regeneration of the diesel particle filter, namely increasing of the exhaust gas temperature, in other words high diesel consumption could for example be started too soon. If such measures are somewhat delayed it is conceivable that no regeneration measures become necessary if, for example an engine operating point with high exhaust gas temperatures occurs again, which is statistically expected.

Additional possible applications are given for example in the case of a premature regeneration for reducing the exhaust gas backpressure and for the efficiency calculation of the regeneration measures.

Additional advantages and arrangements of the invention result from the description and the enclosed drawings.

It is understood that the aforementioned properties and the properties yet to be explained below can be used not only in the respectively specified combination, but also in other combinations or on their own without leaving the scope of the current invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
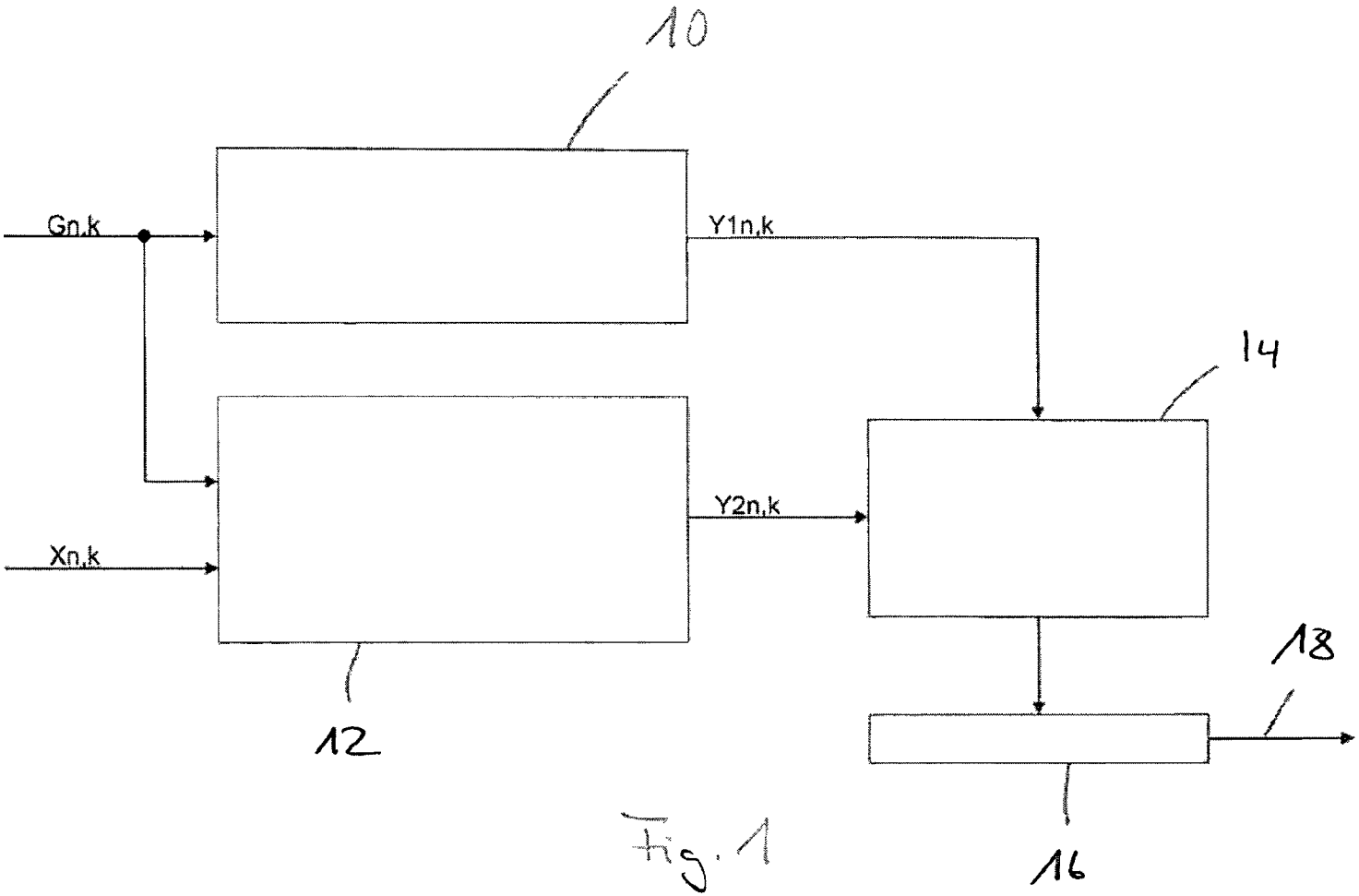
FIG. 1 illustrates a flow chart of one design form of the described method.

Referring now to FIG. 1, values Gn, k for a variable G which describes a physical property of an internal combustion engine enter into a relative distribution function 10 which issues an n * classification, namely a first distribution Y1n, k over a first time period which is limited. If the first time period is selected sufficiently long, then the long-term behavior of the internal combustion engine can be described therewith.

Values Gn, k are also entered into a dependent distribution function 12 for a second time period which is generally shorter than the first time period. Moreover, values Xn, k are entered for an additional variable X. This results in a second distribution Y2n, k, which describes a short-term behavior of the internal combustion engine, in this case dependent on an additional variable. Thus, variable G is evaluated or respectively classified dependent on variable X, which is influenced for example by the behavior of the user. Second distribution Y2n, k represents an n * classification. This can be performed time-limited or unlimited.

In a model 14 a comparison occurs between the first distribution Y1n, k and the second distribution Y2n, k. The result of the comparison is subsequently evaluated (block 16) and information is issued at an output 18 which triggers an event when applicable.

The method therefore statically captures the influence of certain variables through the behavior of the user or respectively the customer. The effects of this influence are calculated in order to adapt the behavior of the entire system, for example the internal combustion engine with allocated exhaust gas treatment system, if necessary.

The same classification occurs hereby for relative distribution function 10 and independent distribution function 12. It is determined, depending on Gn, k in which category the system, for example the internal combustion engine and exhaust gas treatment system are operated at any time.

The following applies therein:

k=1, 2, . . . 5 category

D=0, 1, 2 damping

L>1 learning component

For the case that Gn, k is within a category k:

$$Y1n,k=Y1n-1,k+(Xn,k-Y1n-1,k)/L$$

For the case that Gn, k is outside a category k:

$$Y2n,k=Y2n-1,k+(Y2n-1,k)*D/L$$

Figure 2:
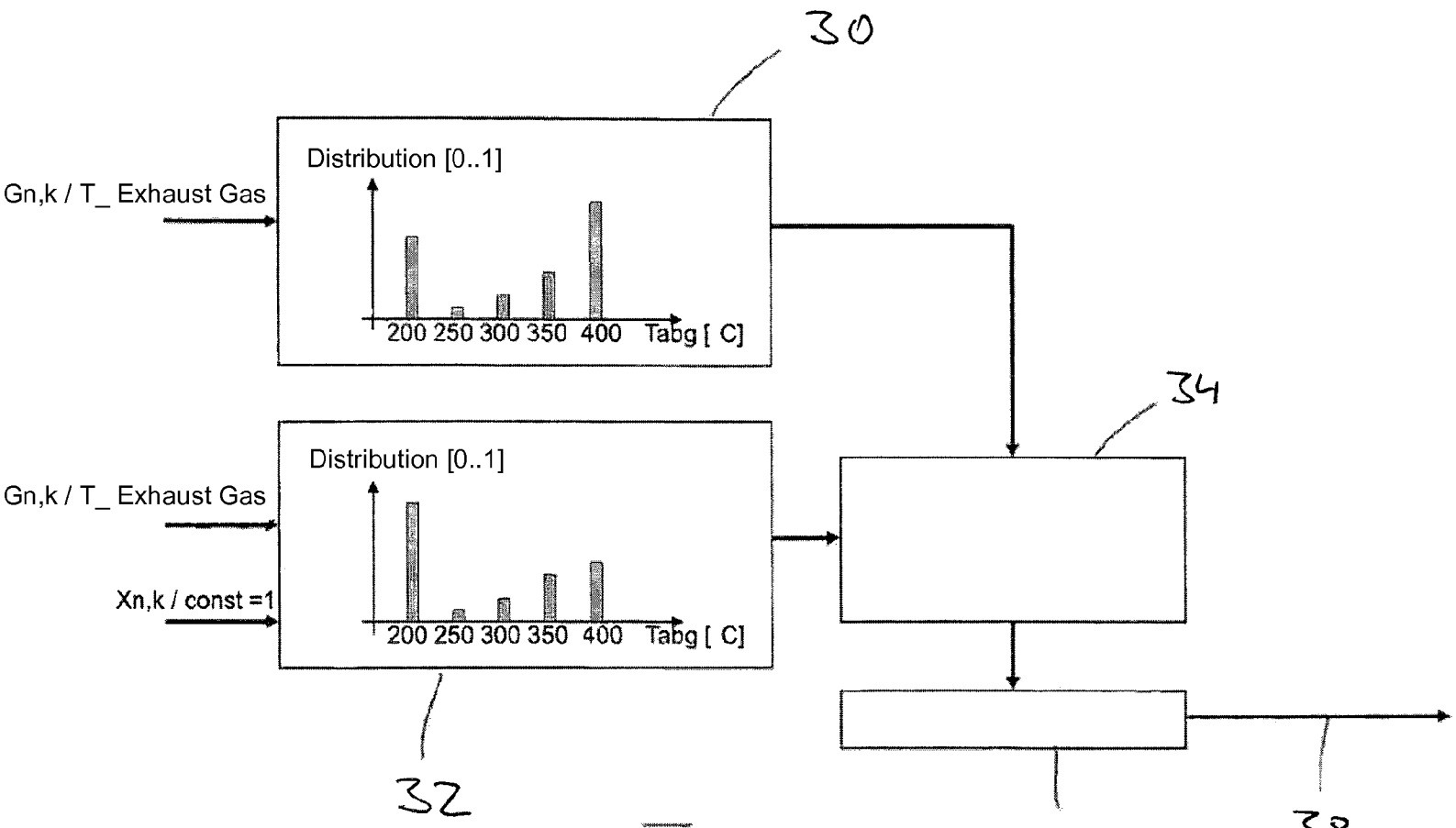
FIG. 2 illustrates a flow chart of an additional design form of the described method.

FIG. 2 illustrates an additional possible version of the method. The illustration shows a relative distribution function 30 and a dependent distribution function 32.

In relative distribution function 30 an exhaust gas temperature distribution is determined over a long time period. In dependent distribution function 32 an exhaust gas temperature distribution is determined over a short time period.

Input variables are values for exhaust gas temperature Gn, k and values Xn, k for an additional variable X which in this case is a constant 1.

It can be seen that values Gn, k are allocated to categories 200° C., 250° C., 300° C., 350° C. and 400° C. All values Gn, k which are less than or equal to 200° C. can hereby for example be allocated to category 200° C. Alternatively, all values Gn, k which are less than 250° C. can be allocated to category 200° C. In this case all values Gn, k which are greater than or equal to 250° C. and less than 300° C. are allocated to category 250° C. This can however be agreed upon as desired.

The resulting distributions are evaluated (block 34), whereby also only certain categories may be examined. For example, only categories>350° C. may be examined during the evaluation. A threshold 36 is imposed on the result of the evaluation. In this case it is recognized that considerably more values are allocated to category 400° C. which results from the relative distribution function 30, than to category 400° C. which results from the dependent distribution function 32. Since consequently high exhaust gas temperatures are expected in the foreseeable future, the regeneration is initially suppressed and corresponding information is provided at an output 38.

In this case the method is based on the following considerations:

If there has not been a phase with high temperature for a long time, but if this is normally the case, the probability for one to occur soon increases. Consequently, a limited delay of the soft thermo-management occurs.

Figure 3:
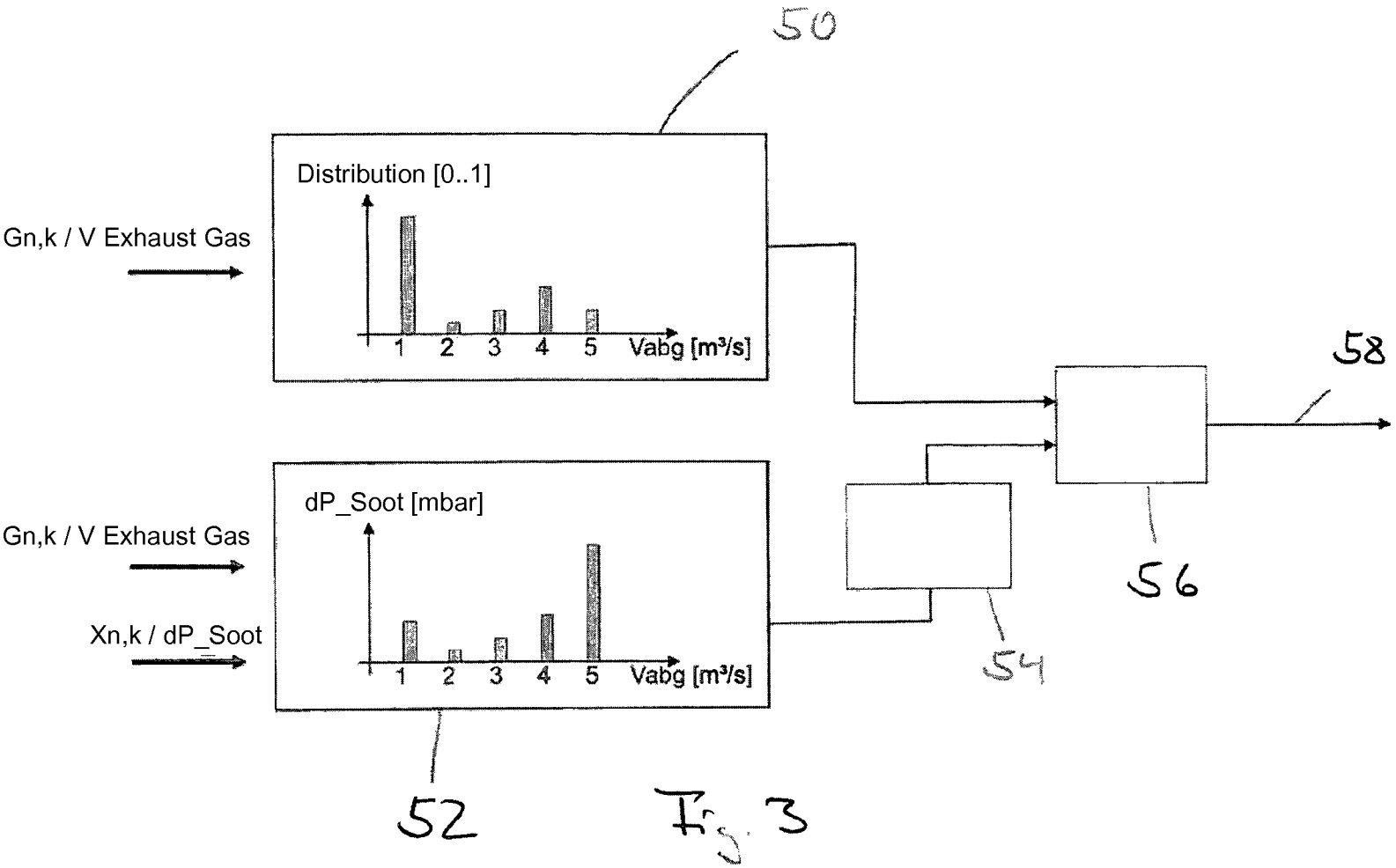
FIG. 3 illustrates a flow chart of yet an additional design form of the described method.

FIG. 3 shows an additional design of the method with a relative distribution function 50 which determines a first distribution over a long time period, and a dependent distribution function 52 which determines a second distribution over a short time period. Input variables are values Gn, k for an exhaust volume. Additional input variables for the dependent distribution function 52 are values Xn, k for a differential pressure.

Relative distribution function 50 which determines a first distribution over a long time period detects in which exhaust gas volume category the internal combustion engine is situated. Dependent distribution function 52 which determines a second distribution over a short time period detects in which exhaust gas volume category the internal combustion engine experiences what level of additional differential pressure dP.

In a model 54 the differential pressure is correlated with a change in consumption. Finally a weighting by comparison is conducted (block 56) and information in regard to additional consumption dependent on the differential pressure is provided at an output 58.

Depending therefore on how often the internal combustion engine is in which exhaust gas category, an additional differential pressure can be determined through the diesel particle filter.

Figure 4:
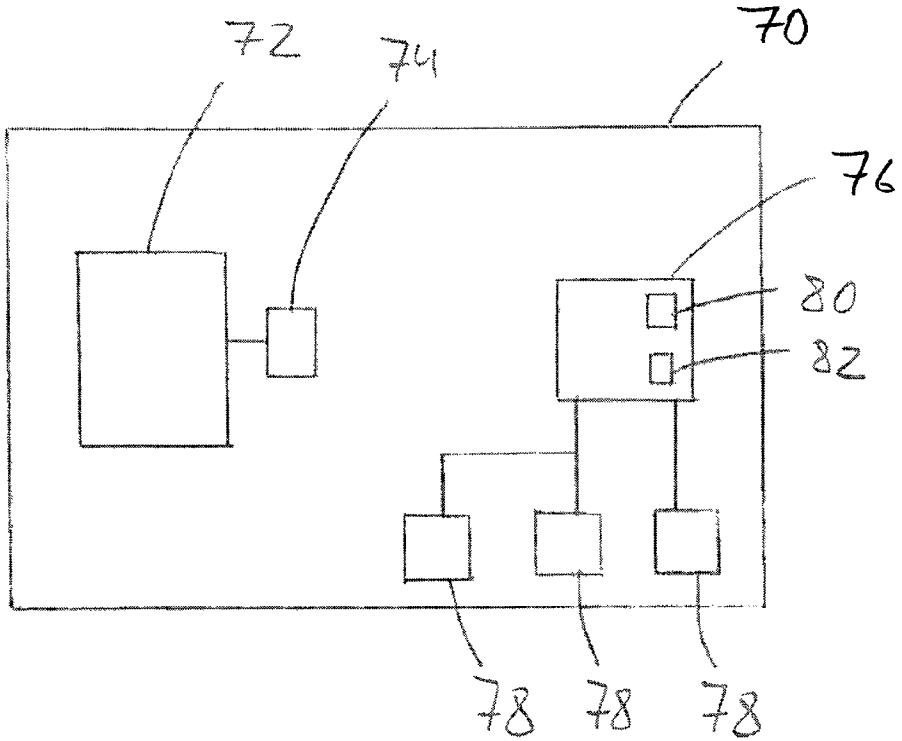
FIG. 4 is a strongly simplified schematic illustration of a design form of a device in which the suggested method would be implemented.

FIG. 4 illustrates in a strongly simplified schematic depiction a device which is identified with reference number 70.

The illustration shows an internal combustion engine 72 which is provided to drive device 70 and to which an exhaust gas treatment system 74 is allocated. In addition a controller 76 is provided which is connected with a number of sensors 78 to detect physical variables.

In controller 76 a comparison can be performed between a first distribution 80 which can be determined with a relative distribution function over a first time period, and a second distribution 82 which can be determined over a relative distribution function or a dependent distribution function over a second time period.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An exhaust gas treatment system for use with an internal combustion engine, comprising:

at least one exhaust gas treatment device, said at least one exhaust gas treatment device being capable of regeneration through an exhaust gas temperature event;

a controller configured to operate the internal combustion engine, based on a method of:

determining a first distribution of values for at least one variable over a first time period, said at least one variable being one of a rotational speed of the internal engine, a speed of a driven device, an exhaust gas temperature, and exhaust gas volume, and an exhaust gas differential pressure, said first distribution of values describing a long-term behavior of the internal combustion engine;

recording and classifying values for the at least one variable over a second time period;

determining a second distribution of values for said at least one variable, said second distribution of values describing a short-term behavior of the internal combustion engine;

comparing the first distribution with the second distribution; and triggering or not triggering said exhaust gas temperature event on the basis of the comparing step.

2. The exhaust gas treatment system according to claim 1, wherein the first distribution is determined by recording and classifying of values of the at least one variable over said first time period.

3. The exhaust gas treatment system according to claim 2, wherein the first time period is longer than the second time period.

4. The exhaust gas treatment system according to claim 3, wherein the first distribution is predetermined in one classification.

5. The exhaust gas treatment system according to claim 1, whereby in the second distribution the at least one variable is classified dependent on at least one second variable.

6. The exhaust gas treatment system according to claim 1, wherein said exhaust gas temperature event is triggered upon deviation of said second distribution of values from said first distribution of values as determined during the comparing step.

7. The exhaust gas treatment system according to claim 1, wherein the comparing step includes comparing a threshold.

8. The exhaust gas treatment system according to claim 1, wherein:

said exhaust gas temperature event is one of an exhaust gas temperature change, a change in the extent of exhaust gas temperature change, and a delay in thermomanagement.

9. The exhaust gas treatment system of claim 1, wherein:

said at least one exhaust gas treatment device further comprises at least one diesel particulate filter.

10. A method of operating an internal combustion engine, comprising the steps of:

providing an exhaust gas treatment system including at least one exhaust gas treatment device, said at least one exhaust gas treatment device being capable of regeneration through an exhaust gas temperature event;

determining a first distribution of values for at least one variable over a first time period, said at least one variable being one of a rotational speed of the internal engine, a speed of a driven device, an exhaust gas temperature, an exhaust gas volume, and an exhaust gas differential pressure, said first distribution of values describing a long-term behavior of the internal combustion engine;

recording and classifying values for the at least one variable over a second time period;

determining a second distribution of values for said at least one variable, said second distribution of values describing a short-term behavior of the internal combustion engine;

comparing the first distribution with the second distribution; and triggering said exhaust gas temperature event on the basis of the comparing step.

11. The method according to claim 10, wherein the first distribution is determined by recording and classifying of values of the at least one variable over said first time period.

12. The method according to claim 11, wherein the first time period is longer than the second time period.

13. The method according to claim 12, wherein the first distribution is predetermined in one classification.

14. The method according to claim 10, whereby in the second distribution the at least one variable is classified dependent on at least one second variable.

15. The method according to claim 10, wherein said exhaust gas temperature event is triggered upon deviation of said second distribution of values from said first distribution of values as determined during the comparing step.

16. The method according to claim 10, wherein the comparing step includes comparing a threshold.

17. The method according to claim 10, wherein:

said exhaust gas temperature event is one of an exhaust gas temperature change, a change in the extent of exhaust gas temperature change, and a delay in thermo-management.

18. The method of claim 10, wherein:

said at least one exhaust gas treatment device further comprises at least one diesel particulate filter.

* * * * *